US010190597B2

(12) United States Patent
Kabasawa

(10) Patent No.: US 10,190,597 B2
(45) Date of Patent: Jan. 29, 2019

(54) VACUUM PUMP AND ROTOR THEREOF

(75) Inventor: Takashi Kabasawa, Chiba (JP)

(73) Assignee: Edwards Japan Limited, Chiba (JP)

( * ) Notice: Subject to any disclaimer, the term of this patent is extended or adjusted under 35 U.S.C. 154(b) by 937 days.

(21) Appl. No.: 14/114,091

(22) PCT Filed: Apr. 2, 2012

(86) PCT No.: PCT/JP2012/058904

§ 371 (c)(1),
(2), (4) Date: Oct. 25, 2013

(87) PCT Pub. No.: WO2012/172851

PCT Pub. Date: Dec. 20, 2012

(65) Prior Publication Data

US 2014/0050607 A1 Feb. 20, 2014

(30) Foreign Application Priority Data

Jun. 17, 2011 (JP) ..... 2011-135484

(51) Int. Cl.
*F04D 29/32* (2006.01)
*F04D 29/52* (2006.01)
(Continued)

(52) U.S. Cl.
CPC ..... *F04D 29/526* (2013.01); *F04D 19/044* (2013.01); *F04D 19/046* (2013.01);
(Continued)

(58) Field of Classification Search
CPC ..... F04D 19/04; F04D 19/042; F04D 19/046
(Continued)

(56) References Cited

U.S. PATENT DOCUMENTS 5,924,841 A * 7/1999 Okamura ..... F04D 19/046 415/176
6,599,084 B1 * 7/2003 Schutz ..... F04D 19/04 415/104
(Continued)

FOREIGN PATENT DOCUMENTS

EP 1318309 A2 11/2003
EP 1508700 A2 2/2005
(Continued)

OTHER PUBLICATIONS

PCT International Search Report dated Jun. 12, 2012 for corresponding Application No. PCT/JP2012/058904.
(Continued)

*Primary Examiner* — Dwayne J White
*Assistant Examiner* — Jason Mikus
(74) *Attorney, Agent, or Firm* — Westman, Champlin & Koeher, P.A.; Theodore M. Magee

(57) ABSTRACT

A rotor of a vacuum pump has a circular member that is driven rotatably, a cylindrical member joined to an outer circumference of the circular member, and a thread groove pump flow path formed between the cylindrical member and a stator member surrounding an outer circumference of the cylindrical member. The cylindrical member is made of a material having at least a feature of lower thermal expansivity or lower creep rate than that of a material of the circular member. A gap of a second region provided between a non-joint portion of the cylindrical member and the stator member is set to be smaller than a gap of a first region provided between a joint portion of the cylindrical member and the stator member.

7 Claims, 6 Drawing Sheets

(51) Int. Cl.
*F04D 19/04* (2006.01)
*F04D 27/02* (2006.01)

(52) U.S. Cl.
CPC ..... *F04D 27/0292* (2013.01); *F04D 29/32* (2013.01); *F04D 29/321* (2013.01)

(58) Field of Classification Search
USPC ..... 415/90
See application file for complete search history.

(56) References Cited

U.S. PATENT DOCUMENTS

| | | | | |
|---|---|---|---|---|
| 6,824,349 | B2 * | 11/2004 | Okudera | F04D 19/04 415/143 |
| 2002/0054815 | A1 * | 5/2002 | Kawasaki | F04D 19/046 415/90 |

FOREIGN PATENT DOCUMENTS

| | | | |
|---|---|---|---|
| JP | S52086576 | A | 7/1977 |
| JP | S6375389 | A | 4/1988 |
| JP | H191096 | | 6/1989 |
| JP | H536094 | | 5/1993 |
| JP | H05332287 | A | 12/1993 |
| JP | 74383 | A | 1/1995 |
| JP | 10122179 | A | 5/1998 |
| JP | 2003172289 | A | 6/2003 |
| WO | 2011070856 | A1 | 6/2011 |
| WO | 2012002084 | A1 | 1/2012 |

OTHER PUBLICATIONS

European Search Report dated Oct. 31, 2014 for corresponding European Application No. 12800013.0-1608.

* cited by examiner

[FIG.1]
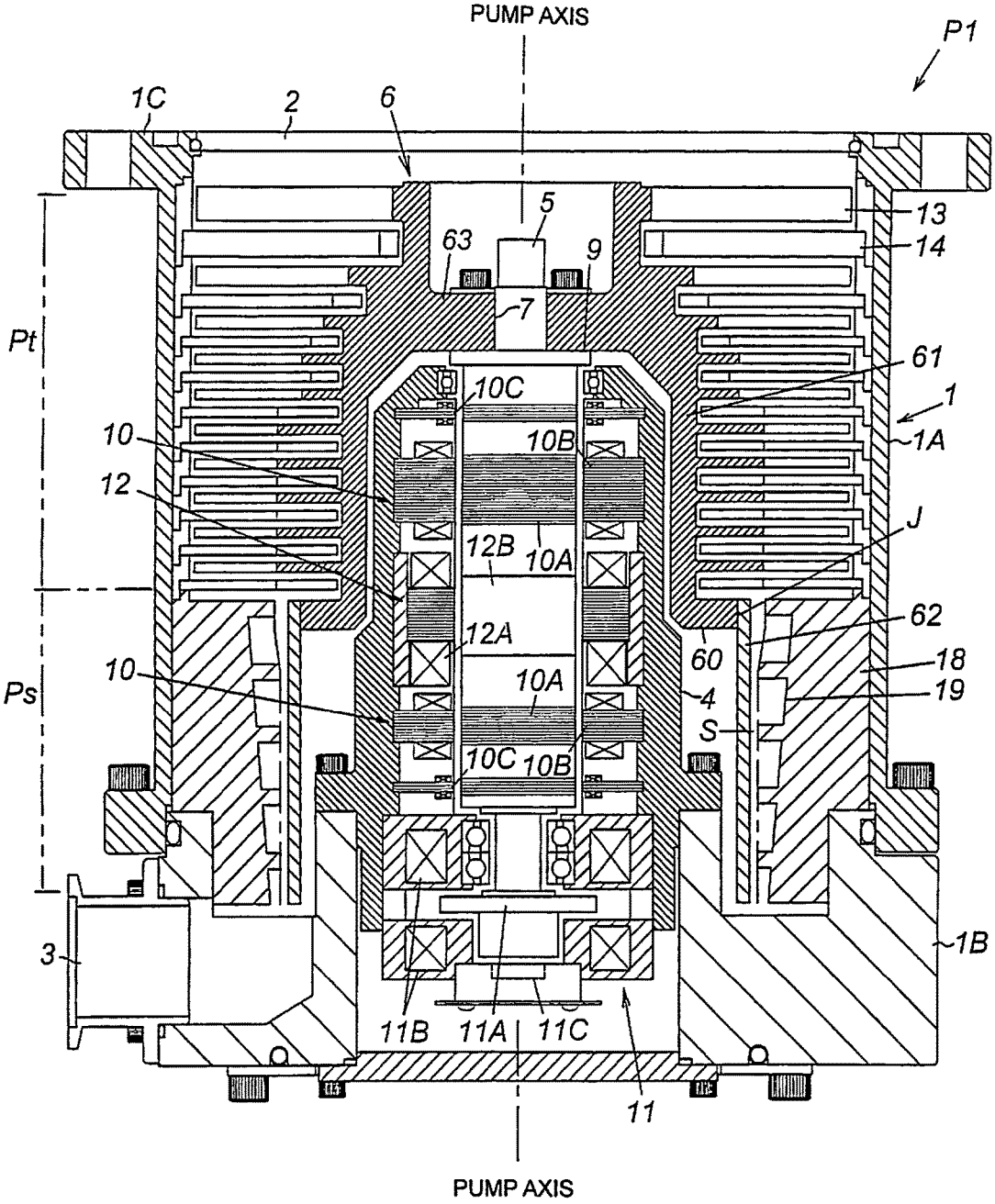

[FIG.2]
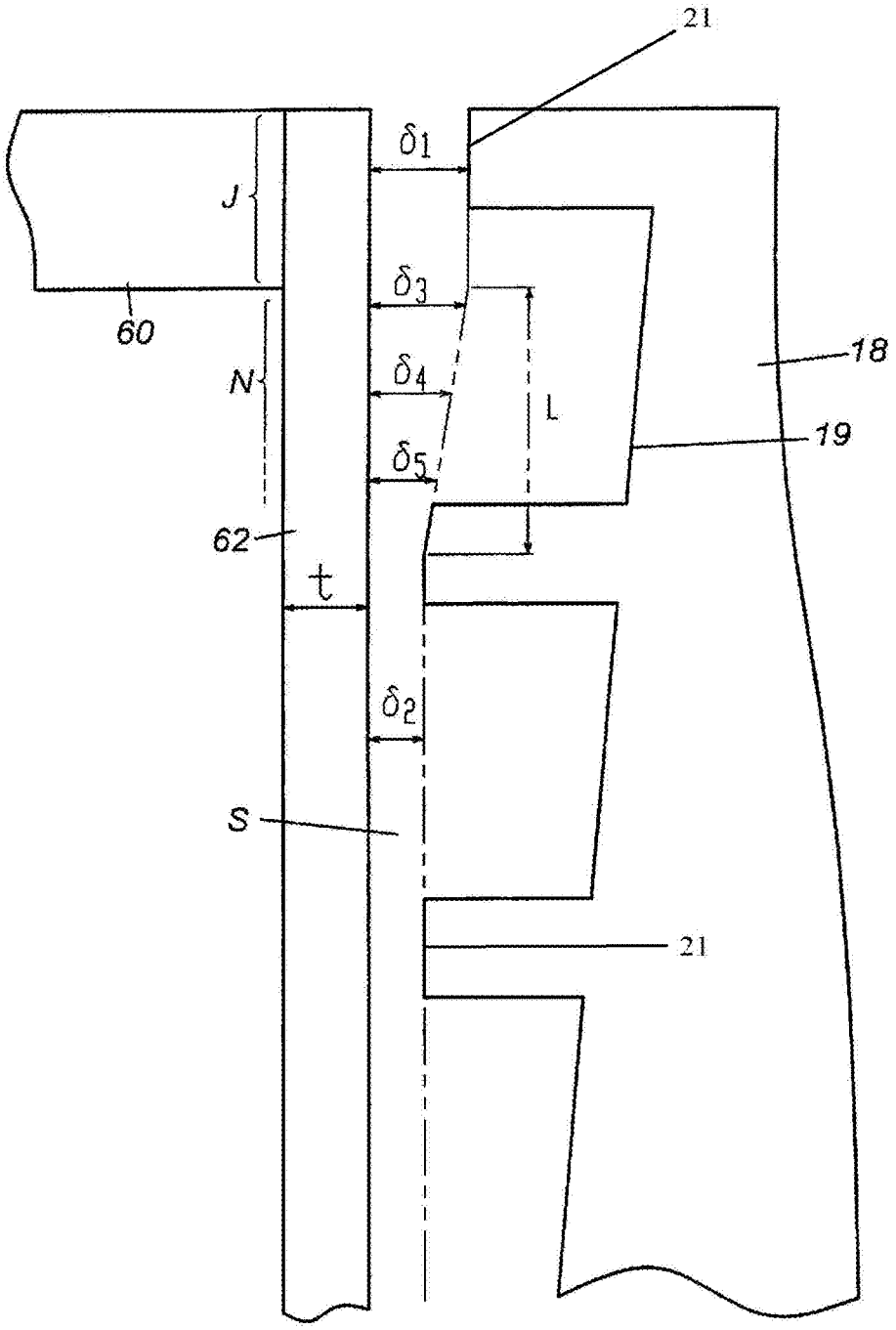

[FIG.3]
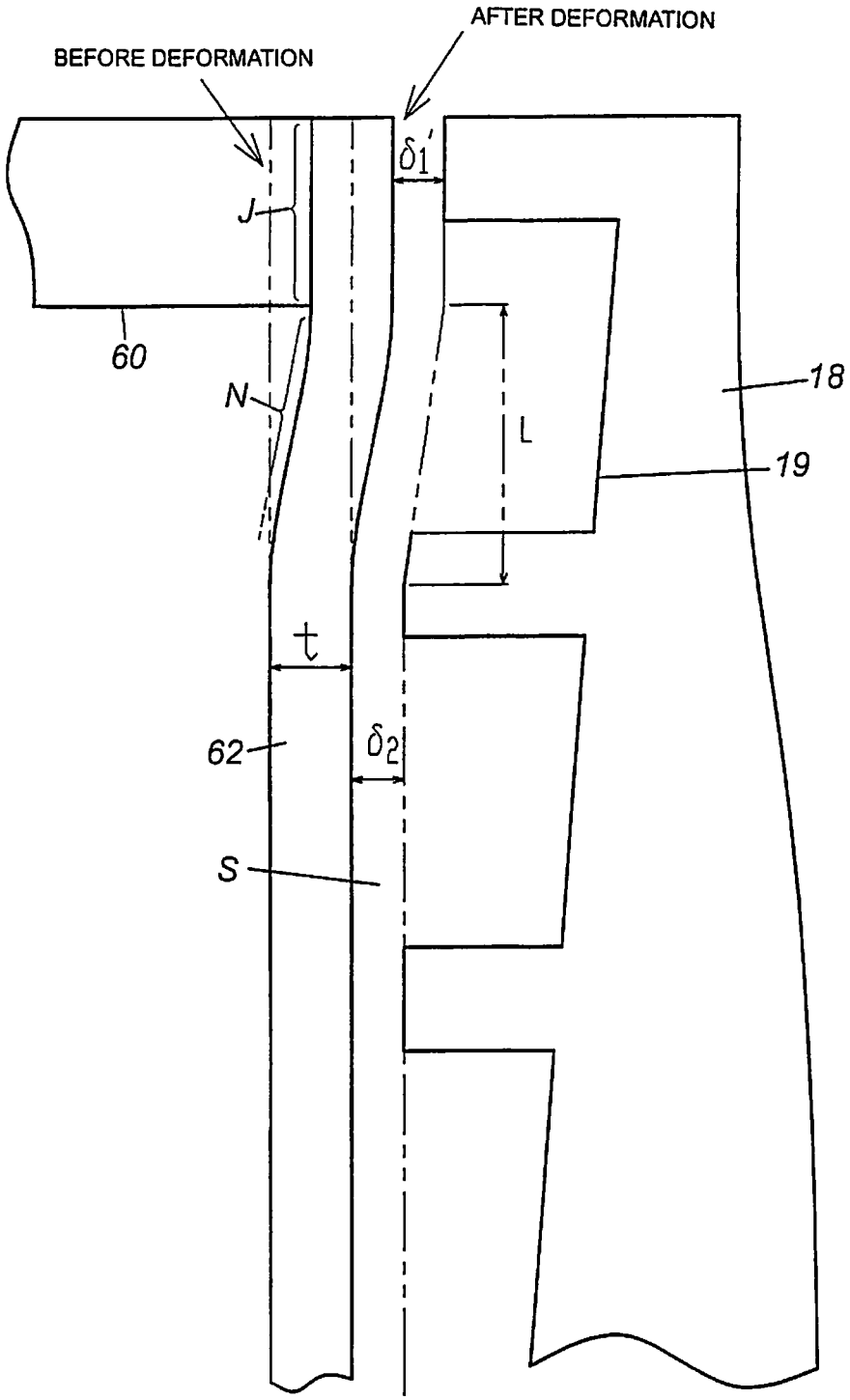

[FIG.4]
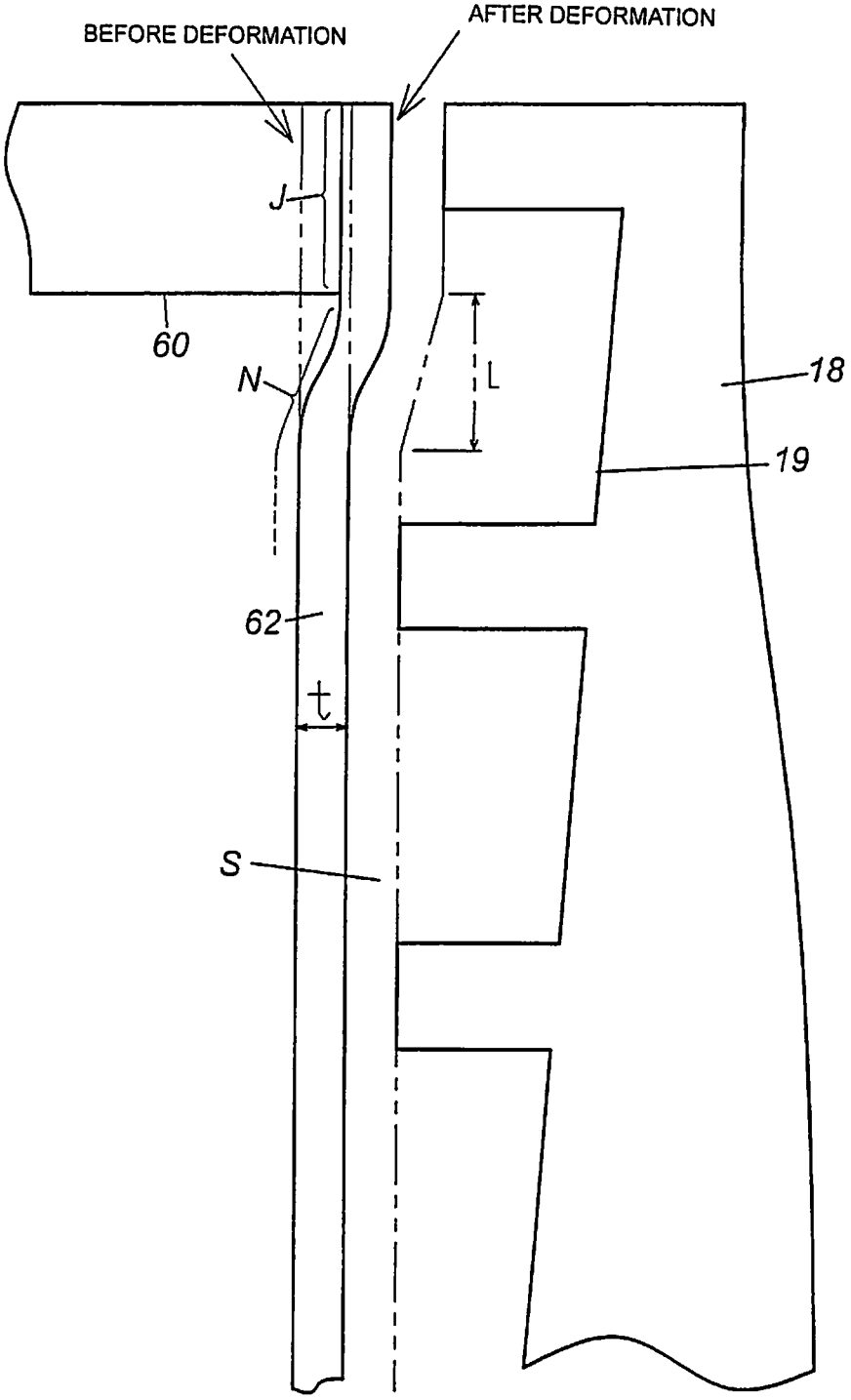

[FIG.5]
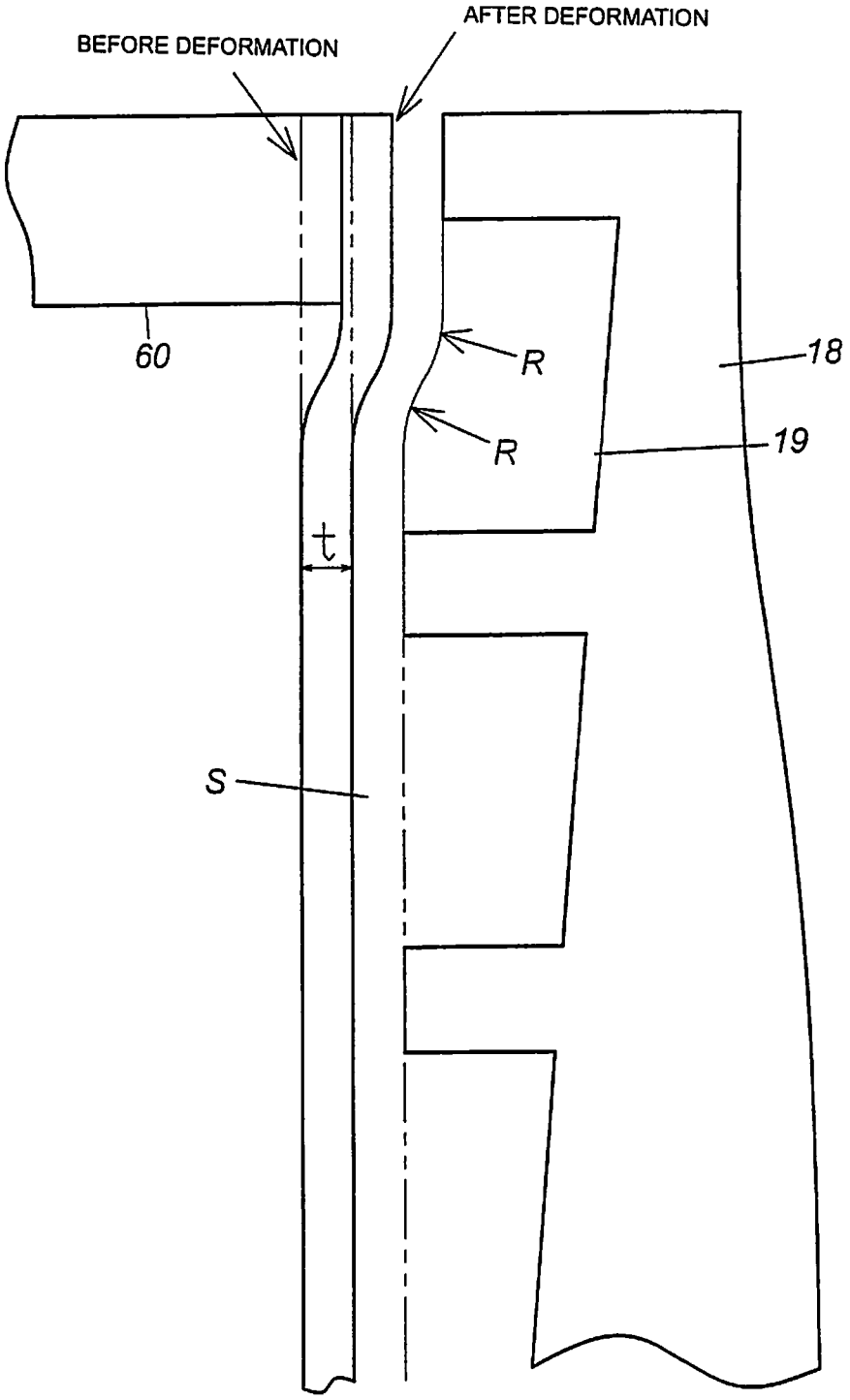

[FIG.6]
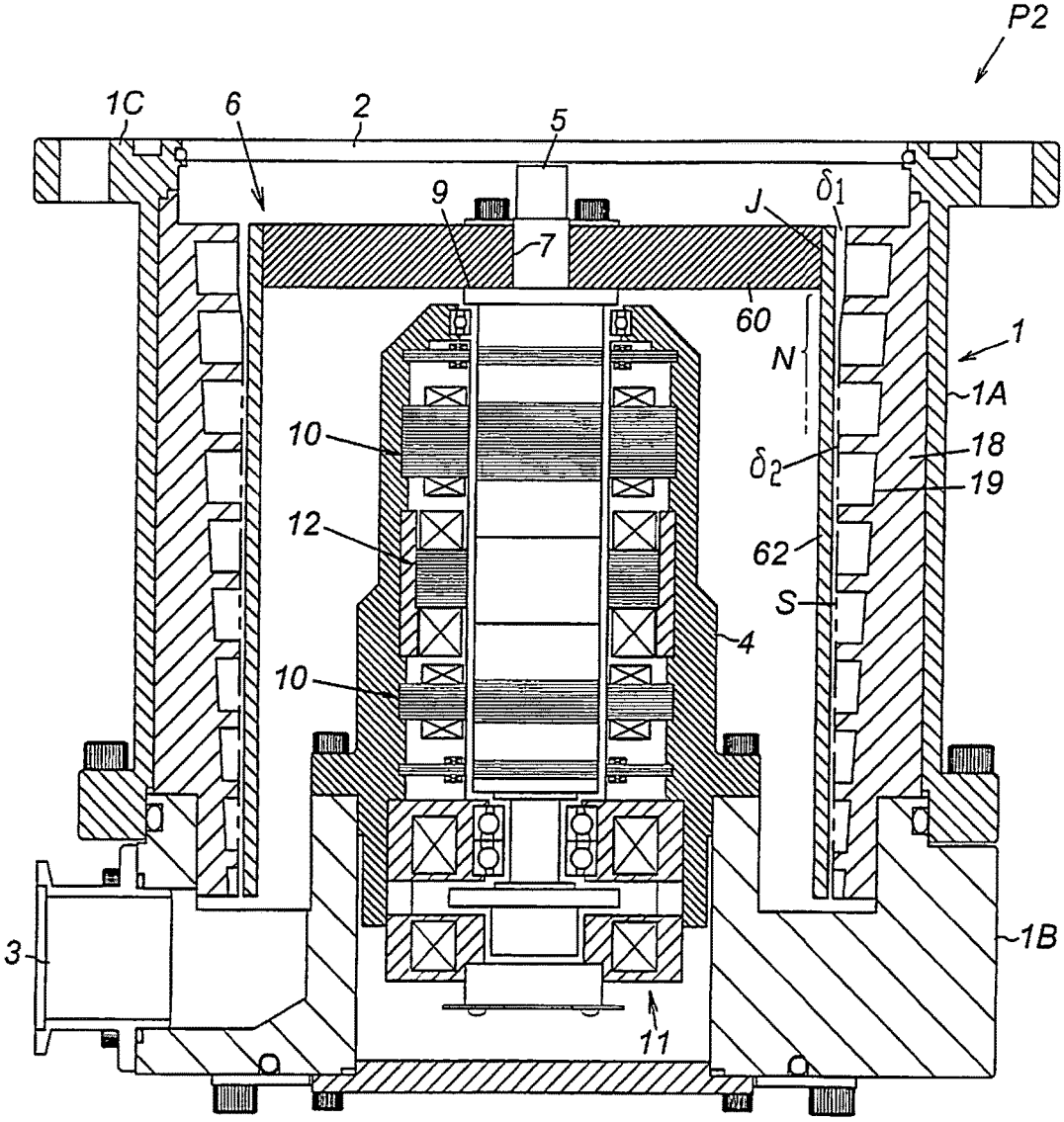

VACUUM PUMP AND ROTOR THEREOF

CROSS-REFERENCE TO RELATED APPLICATION

This Application is a Section 371 National Stage Application of International Application No. PCT/JP2012/058904, filed Apr. 2, 2012, which is incorporated by reference in its entirety and published as WO 2012/172851 on Dec. 20, 2012, not in English, and which claims priority to Japanese Patent Application 2011-135484 filed on Jun. 17, 2011

BACKGROUND

The present invention relates to a vacuum pump that is used as gas exhausting means for a process chamber or other closed chamber of, for example, a semiconductor manufacturing apparatus, a flat-panel display manufacturing apparatus, and a solar panel manufacturing apparatus. The present invention also relates to a rotor for the vacuum pump.

A thread groove-type vacuum pump disclosed in Japanese Patent Application Publication No. S63-75389 and a vacuum pump disclosed in Japanese Utility Model Application Publication No. H5-36094 are known as this type of vacuum pump. These vacuum pumps have a columnar or cylindrical rotary member and a stator member surrounding an outer circumference of the rotary member.

The thread groove-type vacuum pump disclosed in Japanese Patent Application Publication No. S63-75389 and the vacuum pump disclosed in Japanese Utility Model Application Publication No. H5-36094 employ a configuration in which a thread groove pump flow path is formed between the rotary member and the stator member and a configuration in which the rotary member is rotated to exhaust gas through the thread groove pump flow path, by, in case of Japanese Patent Application Publication No. S63-75389, forming a thread groove on an outer circumferential surface of the rotary member and, in case of Japanese Utility Model Application Publication No. H5-36094, forming a thread groove on an inner circumferential surface of the stator member.

According to these vacuum pumps configured as described in Japanese Patent Application Publication No. 563-75389 and Japanese Utility Model Application Publication No. H5-36094, an increase in the gap between the rotary member and the stator member is known to lower their pump performances significantly.

These vacuum pumps, therefore, are designed to prevent the lowering of the pump performances by making the gap between the rotary member and the stator member as narrow as possible in a way that the pumps can be operated safely without having these members come into contact with each other, the gap being set in consideration of thermal expansion and creep of the rotary member that are caused due to centrifugal force generated by rotation of the pumps, as well as variation in manufacture of these rotary and stator members.

Especially in order to set the gap as narrow as possible, in Japanese Patent Application Publication No. S63-75389, the inner circumference of the stator member is formed with a soft material, which is then brought into contact with the rotary member at initial running of the pump, to grind off the contact part therebetween. In Japanese Utility Model Application Publication No. H5-36094, on the other hand, the outer circumferential surface of the rotary member and the inner circumferential surface of the stator member are formed in a taper shape, and the stator member is designed to move in an axial direction of the pump in case of abnormality. In this manner, the rotary member and the stator member are prevented from coming into contact with each other.

The problem with Japanese Patent Application Publication No. S63-75389 is that the process grinding off the contact part between the stator member and the rotary member by making the inner circumference of the stator member contact with the rotary member at initial running of the pump can ruin the corrosion protection coatings of the inner circumference of the stator member and the outer circumference of the rotary member, resulting in a deterioration of the anti-corrosion characteristics of the internal structure of the pump. The problem with Japanese Utility Model Application Publication No. H5-36094, on the other hand, is that, in a case where a gap in a minimum size is formed, providing such a mechanism for moving the stator member in the axial direction of the vacuum pump makes the structure of the vacuum pump complicated.

The discussion above is merely provided for general background information and is not intended to be used as an aid in determining the scope of the claimed subject matter. The claimed subject matter is not limited to implementations that solve any or all disadvantages noted in the background.

SUMMARY

The present invention was contrived in order to solve these problems, and an object thereof is to provide a vacuum pump in which the gap between a rotating cylindrical member and a stator member around an outer circumference of the cylindrical member can be set as narrow as possible without deteriorating the anti-corrosion characteristics of the internal structure of the vacuum pump or complicating the entire structure of the vacuum pump and in which such a narrow gap can contribute to an improvement of pump performance of the vacuum pump. The present invention also aims to provide a rotor for the vacuum pump.

In order to achieve this object, a vacuum pump according to the present invention has: a circular member; a drive means for driving the circular member rotatably on a center thereof; a cylindrical member joined to an outer circumference of the circular member; a stator member surrounding an outer circumference of the cylindrical member; and a thread groove pump flow path formed between the cylindrical member and the stator member, the vacuum pump exhausting gas through the thread groove pump flow path by rotating the circular member and the cylindrical member, wherein the cylindrical member is made of a material having at least a feature of lower thermal expansivity or lower creep rate than that of a material of the circular member, and a gap of a second region provided between a non-joint portion of the cylindrical member and the stator member is set to be smaller than that of a first region provided between a joint portion of the cylindrical member and the stator member.

The vacuum pump according to the present invention may adopt a configuration in which a gap in a boundary between the gap of the first region and the gap of the second region is formed as a taper shape, the size of which decreases gradually from the joint portion toward the non-joint portion. This configuration is applied to a rotor for the vacuum pump of the present invention, as will be described hereinafter.

The vacuum pump according to the present invention may adopt a configuration in which, in a case where a length along an axis line of the cylindrical member is defined as an axial length of the taper shape, the axial length of the taper shape formed by the gap in the boundary is at least three times of a thickness of the cylindrical member. This configuration is applied to the rotor for the vacuum pump of the present invention, as will be described hereinafter.

The vacuum pump according to the present invention may adopt a configuration in which the joint portion of the cylindrical member is provided on an upstream side of the thread groove pump flow path. This configuration is applied to the rotor for the vacuum pump of the present invention, as will be described hereinafter.

A rotor for a vacuum pump according to the present invention has a circular member that is driven rotatably, a cylindrical member joined to an outer circumference of the circular member, and a thread groove pump flow path formed between the cylindrical member and a stator member surrounding an outer circumference of cylindrical member, wherein the cylindrical member is made of a material having at least a feature of lower thermal expansivity or lower creep rate than that of a material of the circular member, and a gap of a second region provided between a non-joint portion of the cylindrical member and the stator member is set to be smaller than a gap of a first region provided between a joint portion of the cylindrical member and the stator member.

As described above, the vacuum pump and its rotor according to the present invention adopt a specific configuration in which the cylindrical member is made of a material that is characterized in having at least lower thermal expansivity or lower creep rate than that of a material of the circular member, and a specific configuration in which the gap of the second region provided between the non-joint portion of the cylindrical member and the stator member is set to be smaller than the gap of the first region provided between the joint portion of the cylindrical member and the stator member. The present invention, therefore, can provide a favorable vacuum pump in which the gap between the rotating cylindrical member and the stator member around the outer circumference of the cylindrical member can be set as narrow as possible as described in (A) below, while, as described in (B) below, preventing the cylindrical member and the stator member from coming into contact with each other, without deteriorating the anti-corrosion characteristics of the internal structure of the vacuum pump or complicating the entire structure of the vacuum pump, and in which such a narrow gap can contribute to an improvement of pump performance of the vacuum pump. The present invention also can provide a rotor for the vacuum pump.

(A) Minimizing the gap Between the Rotating Cylindrical Member and the Stator Member Unlike the circular member, radial creep or thermal expansion of the cylindrical member is unlikely to occur. For this reason, the gap of the second region provided between the cylindrical member and the stator member around the outer circumference of the cylindrical member can be set as narrow as possible, improving the pump performance of the vacuum pump.

(B) Preventing the Rotating Cylindrical member and the Stator Member from Coming into Contact with Each Other Even when the vicinity of the joint portion of the cylindrical member thermally expands or creeps, the deformed cylindrical member and the stator member can effectively prevented from coming into contact with each other because the gap of the first region between the joint portion and the stator member is made wider than the gap of the second region between the non-joint portion and the stator member.

The Summary is provided to introduce a selection of concepts in a simplified form that are further described in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIG. 1 is a cross-sectional diagram of a composite pump to which a vacuum pump according to the present invention is applied;

FIG. 2 is an enlarged diagram showing the vicinity of a joint portion J shown in FIG. 1 (a state before the vicinity of the joint portion of a circular member creeps or thermally expands);

FIG. 3 is an enlarged diagram showing the vicinity of the joint portion J shown in FIG. 1 (a state in which the vicinity of the joint portion of the circular member creeps or thermally expands);

FIG. 4 is an enlarged diagram showing the vicinity of the joint portion J shown in FIG. 1 (a cylindrical member thinner than a second cylindrical member shown in FIG. 3 is employed. This diagram shows a state in which the vicinity of the joint portion of a circular member creeps or thermally expands);

FIG. 5 is an enlarged diagram showing the vicinity of the joint portion J shown in FIG. 1 (gaps δ3 to δ5 in a boundary between a gap δ1 of a first region and a gap δ2 of a second region (see FIG. 2) form a taper shape, wherein the part near the beginning of this taper shape and the part near the end of the same are formed into arches); and FIG. 6 is a cross-sectional diagram of a thread groove pump to which the vacuum pump according to the present invention is applied.

DETAILED DESCRIPTION

Embodiments of the present invention are described hereinafter with reference to the accompanying drawings of the present application.

FIG. 1 is a cross-sectional diagram of a composite pump to which a vacuum pump according to the present invention is applied. FIG. 2 is an enlarged diagram showing the vicinity of a joint portion J shown in FIG. 1 (a state before the vicinity of the joint portion of a circular member creeps or thermally expands).

The composite pump P1 shown in FIG. 1 is used as gas exhausting means for a process chamber or other closed chamber of, for example, a semiconductor manufacturing apparatus, a flat-panel display manufacturing apparatus, and a solar panel manufacturing apparatus.

The composite pump P1 shown in FIG. 1 has, in an outer case 1 thereof, a blade exhaust part Pt that exhausts gas by means of rotary blades 13 and stator blades 14, and a thread groove pump part Ps that exhausts gas using a thread groove 19.

The outer case 1 has a bottomed cylindrical shape configured by integrally coupling a cylindrical pump case 1A and a bottomed cylindrical pump base 1B to each other in a cylindrical axial direction with a bolt. An upper end portion of the pump case 1A is opened to form a gas inlet port 2, and a gas outlet port 3 is provided on a side surface of a lower end portion of the pump base 1B.

The gas inlet port 2 is connected to an unshown closed chamber, such as a process chamber of a semiconductor manufacturing apparatus, by means of an unshown bolt provided in an upper flange 1C of the pump case 1A, the closed chamber generating high vacuum. The gas outlet port 3 is linked to an auxiliary pump, not shown.

A cylindrical stator column 4 containing various electrical components is provided in a central part inside the pump case 1A. The stator column 4 is provided upright by having a lower end thereof fastened with a screw to the pump base 1B.

A rotor shaft 5 is provided on the inside of the stator column 4. The rotor shaft 5 is disposed, with its upper end portion facing the gas inlet port 2 and its lower end portion facing the pump base 1B. The upper end portion of the rotor shaft 5 protrudes upward from an upper end surface of the stator column 4.

The rotor shaft 5 is driven rotatably by a drive motor 12 while having its radial direction and axial direction supported rotatably by radial magnetic bearings 10 and an axial magnetic bearing 11.

The drive motor 12, configured by a stator 12A and a rotator 12B, is provided in the vicinity of substantially a center of the rotor shaft 5. The stator 12A of the drive motor 12 is mounted inside the stator column 4, whereas the rotator 12B of the drive motor 12 is integrated with an outer circumferential surface of the rotor shaft 5.

There is a total of two radial magnetic bearings 10 above and below the drive motor 12. There is one axial magnetic bearing 11 disposed at the lower end portion of the rotor shaft 5.

Each of the two radial magnetic bearings 10 is configured by a radial electromagnetic target 10A attached to the outer circumferential surface of the rotor shaft 5, a plurality of radial electromagnets 10B installed in an inner surface of the stator column 4 in such a manner as to face the radial electromagnetic target 10A, and a radial displacement sensor 10C. The radial electromagnetic target 10A is composed of a laminated steel plate obtained by stacking highly-permeable steel plates. The radial electromagnets 10B magnetically attract the rotor shaft 5 in the radial direction through the radial electromagnetic target 10A. The radial displacement sensor 10C detects a radial displacement of the rotor shaft 5. The rotor shaft 5 is magnetically supported in a floating manner at a predetermined radial position, by controlling the exciting currents of the radial electromagnets 10B in accordance with the value detected by the radial displacement sensor 10C (the radial displacement of the rotor shaft 5).

The axial magnetic bearing 11 is configured by a disk-shaped armature disk 11A attached to an outer circumference of the lower end portion of the rotor shaft 5, axial electromagnets 11B disposed above and below the armature disk 11A in such a manner as to face each other, and an axial displacement sensor 11C disposed slightly away from a lower end surface of the rotor shaft 5. The armature disk 11A is made of a highly-permeable material. The upper and lower axial electromagnets 11B magnetically attract the armature disk 11A in a vertical direction thereof. The axial displacement sensor 11C detects an axial displacement of the rotor shaft 5. The rotor shaft 5 is magnetically supported in a floating manner at a predetermined axial position, by controlling the exciting currents of the upper and lower axial electromagnets 11B in accordance with the value detected by the axial displacement sensor 11C (the axial displacement of the rotor shaft 5).

A rotor 6 functioning as a rotating body of the composite pump P1 is provided on the outside of the stator column 4. The rotor 6 is formed into a cylinder to surround an outer circumference of the stator column 4 and has, around its intermediate position, a circular member 60 made of aluminum or aluminum alloy. The rotor 6 is configured by connecting two cylindrical members of different diameters (a first cylindrical member 61 and a second cylindrical member 62) to each other in an axial direction thereof via the circular member 60.

The first cylindrical member 61 is made of the same material as the circular member 60 (e.g., aluminum or aluminum alloy). The second cylindrical member 62, on the other hand, is made of a material that is characterized in having at least lower thermal expansivity or lower creep rate than that of the material of the first cylindrical member 61 or circular member 60. Examples of such a material include metal such as titanium alloy or precipitation-hardened stainless steel, and fiber-reinforced plastic (FRP) reinforced with high-strength fibers such as aramid fiber, boron fiber, carbon fiber, glass fiber, or polyethylene fiber; however, the examples of the material are not limited thereto.

The first cylindrical member 61 is obtained by machining a chunk of aluminum or aluminum alloy. In the composite pump P1 shown in FIG. 1, the circular member 60 provided in an outer circumference of an end portion of the first cylindrical member 61 is in the form of a flange which is cut out of the chunk of aluminum or aluminum alloy along with the first cylindrical member 61. The second cylindrical member 62, on the other hand, is formed separately from the circular member 60 and the first cylindrical member 61 and then press-fitted to an outer circumference of the circular member 60. Note that the second cylindrical member 62 may be joined to the outer circumference of the circular member 60 by an adhesive.

An upper end of the first cylindrical member 61 is provided with end members 63. The rotor 6 and the rotor shaft 5 are integrated with each other by the end members 63. To obtain such an integrated structure, in the composite pump P1 of FIG. 1, for example, a boss hole 7 is provided between the end members 63, and a stepped shoulder portion (referred to as "rotor shaft shoulder portion 9," hereinafter) is formed in an outer circumference of the upper end portion of the rotor shaft 5. In order to integrate the rotor 6 and the rotor shaft 5, a tip end portion of the rotor shaft 5 above the rotor shaft shoulder portion 9 is fitted into the boss hole 7 between the end members 63, and then the end members 63 and the rotor shaft shoulder portion 9 are fastened by bolts.

The rotor 6, configured by the first and second cylindrical members 61 and 62 and the circular member 60, is supported by the radial magnetic bearings 10 and the axial magnetic bearing 11 via the rotor shaft 5 rotatably on the shaft center (the rotor shaft 5). This supported rotor 6 is driven rotatably on the rotor shaft 5 as the drive motor 12 rotates the rotor shaft 5. Therefore, in the composite pump P1 shown in FIG. 1, a pump supporting/rotary drive system with the rotor shaft 5, the radial magnetic bearings 10, the axial magnetic bearing 11, and the drive motor 12 functions as driving means for driving the circular member 60 and the first and second cylindrical members 61 and 62 rotatably on the center of the system.

<<Detailed Configuration of Blade Exhaust Part Pt>>

In the composite pump P1 shown in FIG. 1, the section on the upstream side of the rotor 6 (the range between roughly an intermediate position of the rotor 6 and an end portion of the rotor 6 near the gas inlet port 2, and the same applies hereinafter) with respect to substantially the intermediate position of the rotor 6 (specifically, the position of the circular member 60, and the same applies hereinafter) functions as the blade exhaust part Pt. The below describes a detailed configuration of the blade exhaust part Pt.

The first cylindrical member 61, the component located on the upstream side of the rotor 6 with respect to substantially the intermediate position of the rotor 6, configures a part of the rotor 6 that is rotated as a rotating body of the blade exhaust part Pt. The plurality of rotary blades 13 are provided integrally in an outer circumferential surface of the first cylindrical member 61. The plurality of rotary blades 13 are arranged in a radial manner around the rotor shaft 5 which is an axis of rotation of the rotor 6 or around a shaft center of the outer case 1 (referred to as "pump shaft center," hereinafter). Further, the plurality of stator blades 14 are provided on an inner circumferential surface of the pump case 1A. These stator blades 14, too, are arranged in a radial manner around the pump shaft center. The blade exhaust part Pt is formed by alternately disposing these steps of rotary blades 13 and stator blades 14 along the pump shaft center.

The rotary blades 13 are each formed into a blade-like cut workpiece by being cut along with an outer-diameter machined part of the first cylindrical member 61 and are inclined at an angle so that gas molecules are exhausted optimally. The stator blades 14, too, are inclined at an angle so that the gas molecules are exhausted optimally.

<<Description of Operations of Blade Exhaust Part Pt>>

In the blade exhaust part Pt with the configuration described above, the rotor shaft 5, the rotor 6, and the plurality of rotary blades 13 are integrally rotated at high speed by activating the drive motor 12, wherein the top rotary blade 13 applies momentum to the gas molecules entering from the gas inlet port 2, so that the gas molecules migrate from the gas inlet port 2 towards the gas outlet port 3. The gas molecules with this momentum for the exhaust direction are carried to the next rotary blade 13 by the stator blades 14. By repeatedly applying the momentum to the gas molecules and carrying the gas molecules through the plurality of blades, the gas molecules existing at the gas inlet port 2 gradually migrate towards the downstream side of the rotor 6 to reach the upstream side of the thread groove pump part Ps.

<<Detailed Configuration of Thread Groove Pump Part Ps>>

In the composite pump P1 shown in FIG. 1, the part on the downstream side of the rotor 6 with respect to substantially the intermediate position of the rotor 6 (the range between roughly the intermediate position of the rotor 6 and the end portion of the rotor 6 near the gas outlet port 3, and the same applies hereinafter) functions as the thread groove pump part Ps. The below describes a detailed configuration of the thread groove pump part Ps.

The second cylindrical member 62, the component located on the downstream side of the rotor 6 with respect to substantially the intermediate position of the rotor 6, is a part that is rotated as a rotating member of the thread groove pump part Ps. A tubular stator member 18 is provided in an outer circumference of the second cylindrical member 62 as a thread groove pump stator. This tubular stator member (thread groove pump stator) 18 is configured to surround the outer circumference of the second cylindrical member 62. Note that a lower end portion of the stator member 18 is supported by the pump base 1B.

A spiral-shaped thread groove pump flow path S is provided between the stator member 18 and the second cylindrical member 62. The example shown in FIG. 1 employs a configuration in which the thread groove pump flow path S is formed between the second cylindrical member 62 and the stator member 18 by forming an outer circumferential surface of the second cylindrical member 62 into a smooth curved surface and forming the spiral thread groove 19 on an inner surface of the stator member 18. In place of this configuration, the example shown in FIG. 1 may employ a configuration in which the thread groove pump flow path S is formed between the second cylindrical member 62 and the stator member 18 by forming the thread groove 19 on the outer circumferential surface of the second cylindrical member 62 and forming the inner surface of the stator member 18 into a smooth curved surface.

The thread groove 19 gradually becomes shallower towards the bottom of the illustrated configuration in such a manner that the thread groove pump part Ps forms a tapered cone. The thread groove 19 is engraved in a spiral manner from an upper end of the stator member 18 towards a lower end of the same.

The thread groove pump part Ps moves the gas while compressing it, by taking advantage of a drag effect generated by the thread groove 19 and the outer circumferential surface of the second cylindrical member 62. Therefore, the thread groove 19 is the deepest in the vicinity of an upstream entrance of the thread groove pump flow path S (an opening end of the flow path in the vicinity of the gas inlet port 2) and is the shallowest in the vicinity of a downstream exit of the thread groove pump flow path S (an opening end of the flow path in the vicinity of the gas outlet port 3).

As described above, the second cylindrical member 62 is fitted and connected to the outer circumference of the circular member 60, wherein a gap δ1 of a first region provided between this joint portion (referred to as "joint portion J of the second cylindrical member 62," hereinafter) and a crest 21 of thread groove 19 of the stator member 18 is set to be greater than gaps δ2 to δ5 of a second region provided between crest 21 of thread groove 19 of the stator member 18 and a section other than the joint portion J (referred to as "non-joint portion N of the second cylindrical member 62," hereinafter), as shown in FIG. 2 (δ1>δ2, δ1>δ3, δ1>δ4, δ1>δ5). In other words, in the example shown in FIG. 2, the gaps δ1 to δ5 of the second region are set to be narrower than the gap δ1 of the first region.

Although the circular member 60 creeps or thermally expands radially to some extent because the circular member 60 is made of metal such as aluminum or aluminum alloy, as described above, the second cylindrical member 62 connected to the circular member 60 thermally expands less significantly compared to the circular member 60 and is made of a material having a lower creep rate than that of the material of the circular member 60, as described above. Thus, unlike the circular member 60, radial creep or thermal expansion of the second cylindrical member 62 is unlikely to occur.

Therefore, when the creep phenomenon and thermal expansion occur in the composite pump P1 of FIG. 1 due to heat, centrifugal force and the like that are generated in long term continuous running of the composite pump P1, only a part of the cylindrical member 62 in the vicinity of the joint portion J is deformed as shown in FIG. 3. However, the long-term continuous running of the composite pump P1 does not cause a deformation in most of the non-joint portion N of the cylindrical member 62.

Hence, in the composite pump P1 shown in FIG. 1, the gap δ2 of the second region between the non-joint portion N of the second cylindrical member 62 and the stator member 18 can be made as narrow as possible as shown in FIG. 2, thereby improving pump performance of the composite pump P1. In addition, contact between the second cylindrical member 62 and the stator member 18 caused by the abovementioned deformation of the part near the joint portion J can be prevented by making the gap δ1 of the first region wider than the gap δ2 of the second region in consideration of the deformation of the part near the joint portion J, as shown in FIG. 2, the gap δ1 of the first region being provided between the joint portion J of the second cylindrical member 62 and the stator member 18.

The joint portion J of the second cylindrical member 62 is located on the upstream side of the thread groove pump flow path S, as shown in FIG. 1. Due to low pressure in the upstream side of the thread groove pump flow path S, only a small amount of gas escaping the gap δ1 of the first region flows backward, despite the wide gap δ1 of the first region provided between the joint portion J and the stator member 18. This means that the impact of backflow of the gas on the pump performance is negligible.

As shown in FIG. 2, the gaps δ3 to δ5 in a boundary between the gap δ1 of the first region and the gap δ2 of the second region are configured to taper to become gradually narrower from the joint portion J towards the non-joint portion N tilting an inner circumferential surface of the stator member 18. The part near the beginning of this tapered structure and the part near the end of the same may be formed into arches R, as shown in FIG. 5.

The abovementioned deformation that occurs in the part near the joint portion J of the second cylindrical member (the creep phenomenon or thermal expansion. The same applies hereinafter) gradually becomes smaller from the joint portion J towards the non-joint portion N. Because the gaps δ3 to δ5 in the boundary between the gap δ1 of the first region and the gap δ2 of the second region are configured to gradually become narrower in response to the deformation of the part near the joint portion J in the composite pump P1 shown in FIG. 1, wasted gaps can be minimized, further improving the pump performance.

When the length along the axis line of the second cylindrical member 62 is taken as an axial length L of the above described taper shape, as shown in FIG. 2, the axial length L of the taper shape formed by the gaps δ3 to δ5 in the boundary is at least three times of the thickness t of the second cylindrical member 62.

The thickness t of the second cylindrical member 62 can be increased as shown in, for example, FIGS. 2 and 3 or reduced as shown in FIG. 4. As is clear by comparing FIG. 3 and FIG. 4, how the part near the joint portion J of the second cylindrical member 62 becomes deformed varies depending on the thickness t.

For instance, when the thickness t of the second cylindrical member 62 is great, the taper shape that is generated due to the deformation of the part near the joint portion J inclines gently as shown in FIG. 3. However, as shown in FIG. 4 when the thickness t is small, the taper shape that is generated due to the deformation of the part near the joint portion J inclines steeply. In the composite pump P1 shown in FIG. 1, because the axial length L of the taper shape formed by the gaps δ3 to δ5 in the boundary between the gap δ1 of the first region and the gap δ2 of the second region is set to be at least three times of the thickness t of the second cylindrical member 62, the axial length L of the taper shape formed by the gaps δ3 to δ5 in the boundary can be set in consideration of the thickness t of the second cylindrical member 62. Thus, wasted gaps can be minimized, further improving the pump performance.

<<Description of Operations of Thread Groove Pump Part Ps>>

As described in <<Description of Operations of Blade Exhaust Part Pt>>, the gas molecules that have reached the upstream side of the thread groove pump part Ps further migrate to the thread groove pump flow path S. Due to the effect caused by the rotation of the second cylindrical member 62, or the drag effect caused by the outer circumferential surface of the second cylindrical member 62 and the thread groove 19, the gas molecules then further migrate towards the gas outlet port 3 while being compressed from an intermediate flow into a viscous flow. The gas molecules are eventually discharged to the outside through an auxiliary pump, not shown.

FIG. 6 is a cross-sectional diagram of a thread groove pump to which the vacuum pump according to the present invention is applied. The thread groove pump P2 shown in FIG. 6 does not have the blade exhaust part Pt of the composite pump P1 shown in FIG. 1. As with the composite pump P1 of FIG. 1, the thread groove pump P2 is basically configured by the circular member 60, the drive means for driving the circular member 60 rotatably on the center thereof (specifically, the pump supporting/rotary drive system with the rotor shaft 5, the radial magnetic bearings 10, the axial magnetic bearing 11, and the drive motor 12), the cylindrical member 62 connected to the outer circumference of the circular member 60, the stator member 18 which is a thread groove pump stator surrounding the outer circumference of the cylindrical member 62, and the thread groove pump flow path S formed between the cylindrical member 62 and the stator member 18, wherein gas is discharged through the thread groove pump flow path S by the rotation of the circular member 60 and the cylindrical member 62. Thus, the same reference numerals are used to indicate the same members, and detailed explanation thereof is omitted accordingly. As with the rotor 6 shown in FIG. 1, the rotor 6 configured by the circular member 60 and the cylindrical member 62 is integrated with the rotor shaft 5.

As with the composite pump P1 shown in FIG. 1, the thread groove pump P2 of FIG. 6 employs the configuration in which the cylindrical member 62 thermally expands less significantly compared to the circular member 60 and is made of a material having a lower creep rate than that of the material of the circular member 60, as well as the configuration in which the gap δ1 of the first region between the joint portion J of the cylindrical member 62 and the stator member 18 is greater than the gap δ2 of the second region between the non-joint portion N of the cylindrical member 62 and the stator member 18. Therefore, as with the composite pump P1 shown in FIG. 1, the thread groove pump P2 can prevent the cylindrical member 62 and the stator member 18 from coming into contact with each other, while improving its pump performance.

In the thread groove pump P2 of FIG. 6 as well, the joint portion J of the cylindrical member 62 is located on the upstream side of the thread groove pump flow path S, as shown in FIG. 6. Due to low pressure in the upstream side of the thread groove pump flow path S, only a small amount of gas escaping the gap δ1 of the first region flows backward, despite the wide gap δ1 of the first region provided between the joint portion J and the stator member 18. This means that the impact of backflow of the gas on the pump performance is negligible.

Furthermore, the thread groove pump P2 of FIG. 6, too, employs the configuration in which the gaps (see the gaps δ3 to δ5 in FIG. 2) in the boundary between the gap δ1 of the first region and the gap δ2 of the second region are configured to taper to become gradually narrower from the joint portion J towards the non-joint portion N. Therefore, as with the composite pump P1 shown in FIG. 1, the pump performance can further be improved.

In addition, in the thread groove pump P2 of FIG. 6 as well, the axial length of this taper shape formed by the gaps in the boundary is preferably set to be at least three times of the thickness of the cylindrical member 62. This configuration is the same as that of the composite pump P1 illustrated with reference to FIG. 1.

The present invention is not limited to the embodiments previously described, and can be modified by those who have ordinary knowledge in the corresponding field within the technical idea of the present invention.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

EXPLANATION OF REFERENCE NUMERALS

1 Outer case
1A Pump case
1B Pump base
1C Flange
2 Gas inlet port
3 Gas outlet port
4 Stator column
5 Rotor shaft
6 Rotor
60 Circular member
61 First cylindrical member
62 Second cylindrical member
63 End member
7 Boss hole
9 Rotor shaft shoulder portion
10 Radial magnetic bearing
10A Radial electromagnetic target
10B Radial electromagnet
10C Radial displacement sensor
11 Axial magnetic bearing
11A Armature disk
11B Axial electromagnet
11C Axial displacement sensor
12 Drive motor
12A Stator
12B Rotator
13 Rotary blade
14 Stator blade
18 Stator member
19 Thread groove
L Axial length of taper shape
P1 Composite pump (vacuum pump)
P2 Thread groove pump (vacuum pump)
Pt Blade exhaust part
Ps Thread groove pump part
S Thread groove pump flow path
t Thickness of cylindrical member
δ1 Gap of first region
δ2 Gap of second region
δ3, δ4, δ5 Gaps in boundary between first region and second region

What is claimed is:

1. A vacuum pump, comprising:
a circular member;
a drive means for driving the circular member rotatably on a center thereof;
a cylindrical member joined to an outer circumference of the circular member;
a stator member surrounding an outer circumference of the cylindrical member; and
a thread groove pump flow path formed between the cylindrical member and the stator member,
the vacuum pump exhausting gas through the thread groove pump flow path by rotating the circular member and the cylindrical member, wherein
the cylindrical member is made of a material having at least a feature of lower thermal expansivity or lower creep rate than that of a material of the circular member, and
a gap of a first region provided between a joint portion of the cylindrical member and a crest of a thread groove formed on an inner surface of the stator member is set to be larger than a gap of a second region provided between a non-joint portion of the cylindrical member and a crest of the thread groove formed on the inner surface of the stator member around the entire outer circumference of the cylindrical member by an amount to accommodate thermal expansion of the circular member or an amount of expansion by creep of the circular member.

2. The vacuum pump according to claim 1, wherein a gap in a boundary portion between the first region and the second region is formed as a taper shape, the size of which decreases gradually from the joint portion toward the non-joint portion.

3. The vacuum pump according to claim 2, wherein, in a case where a length along an axis line of the cylindrical member is defined as an axial length of the taper shape, the axial length of the taper shape formed by the gap in the boundary portion is at least three times of a thickness of the cylindrical member.

4. The vacuum pump according to claim 1, wherein the joint portion of the cylindrical member is provided on an upstream side of the thread groove pump flow path.

5. The vacuum pump according to claim 2, wherein the joint portion of the cylindrical member is provided on an upstream side of the thread groove pump flow path.

6. The vacuum pump according to claim 3, wherein the joint portion of the cylindrical member is provided on an upstream side of the thread groove pump flow path.

7. A rotor which has a circular member driven rotatably and a cylindrical member joined to an outer circumference of the circular member and which is used in a vacuum pump, wherein,
the cylindrical member being made of a material having at least a feature of lower thermal expansivity or lower creep rate than that of a material of the circular member,
a thread groove pump flow path being formed between the cylindrical member of the rotor and a stator member surrounding an outer circumference of the cylindrical member by incorporating the rotor in the vacuum pump, and
a gap of a first region provided between a joint portion of the cylindrical member and a crest of a thread groove formed on an inner surface of the stator member is set larger than a gap of a second region provided between a non-joint portion of the cylindrical member and a crest of the thread groove formed on the inner surface of the stator member around the entire outer circumference of the cylindrical member by an amount to accommodate thermal expansion of the circular member or an amount of expansion by creep of the circular member.

* * * * *